United States Patent [19]

Hoexter et al.

[11] 3,937,052

[45] Feb. 10, 1976

[54] MACHINE FOR ROLLING AND CURVING PRINTING PLATES

[75] Inventors: Rolf Hoexter; Thomas M. Morris, both of Fort Lee, N.J.

[73] Assignee: Mosstype Corporation, Waldwick, N.J.

[22] Filed: Jan. 29, 1975

[21] Appl. No.: 545,210

[52] U.S. Cl. ..... 72/166; 72/DIG. 14

[51] Int. Cl.² ..... B21D 5/14

[58] Field of Search ..... 72/166, 199, 365, 366, 72/169, DIG. 14

[56] References Cited

UNITED STATES PATENTS

| | | | |
|---|---|---|---|
| 2,394,019 | 2/1946 | Socke | 72/DIG. 14 |
| 2,454,282 | 11/1948 | Johnson | 72/169 |
| 3,205,689 | 9/1965 | Joseph | 72/146 |
| 3,371,513 | 3/1968 | Achler et al. | 72/166 |
| 3,442,109 | 5/1969 | Drolot | 72/240 |

*Primary Examiner*—Milton S. Mehr

[57] ABSTRACT

A machine for rolling and curving a metal backed rubber printing plate to conform it to the circumference of a printing cylinder. The machine includes a deflection bar having a longitudinal groove therein which accommodates and partly recesses a forming roller of small diameter. The bar is supported between a pair of clamping blocks which are pivotally mounted, means being provided to simultaneously swing the blocks to a predetermined degree to bow the bar and the roller held thereby. Cooperating with the forming roller is a large diameter driven roller of elastomeric material whose position relative to the forming roller is adjustable to define a nip for receiving the plate to be curved and for pressing the plate against the forming roller as it is conveyed through the nip to impart a desired curvature thereto, the bow formation of the forming roller producing a radius of curvature in the plate which gradually increases as one goes from the center to the outer edge thereof.

11 Claims, 9 Drawing Figures

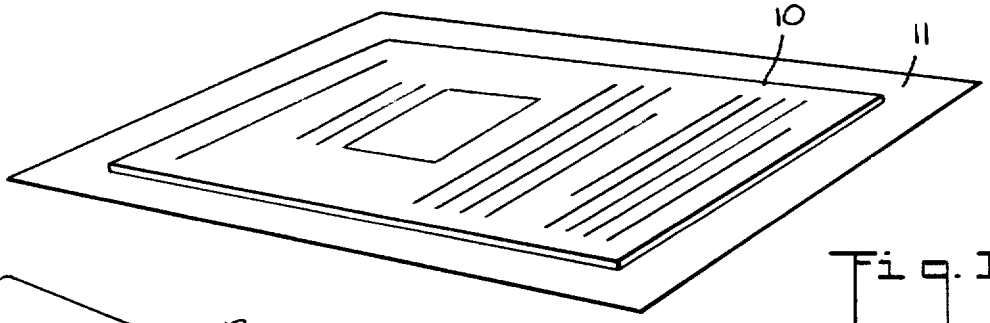
Fig. 1.
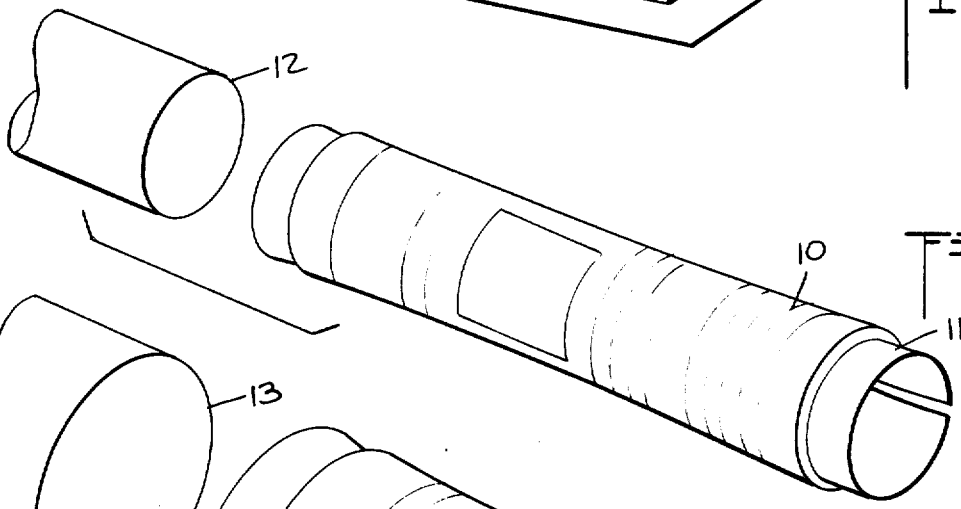
Fig. 2.
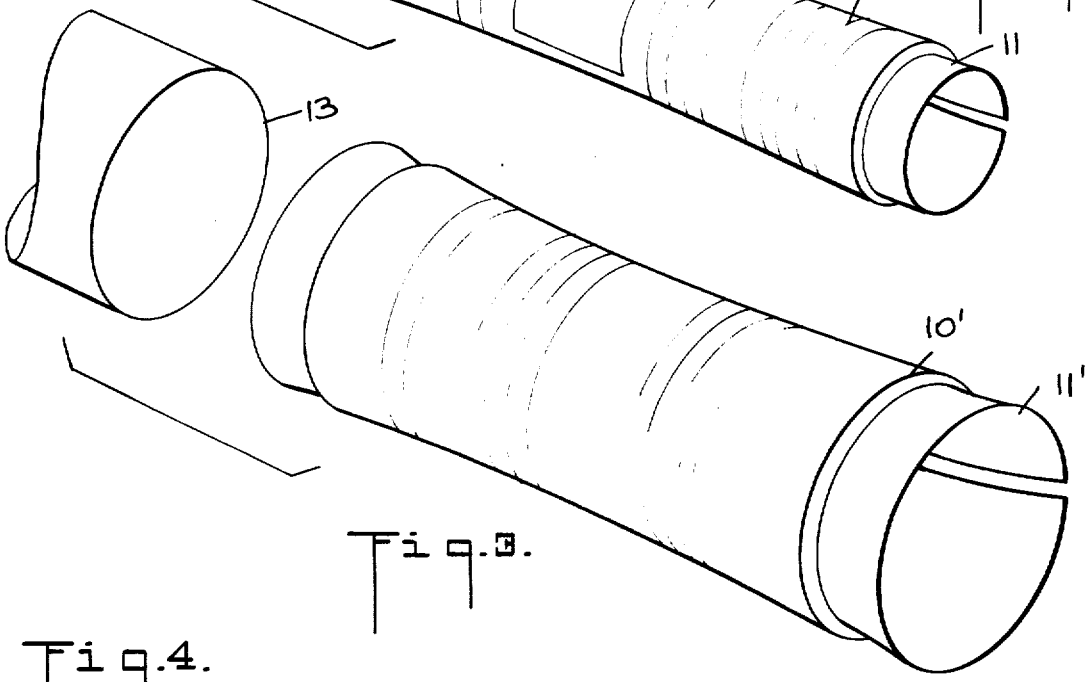
Fig. 3.
Fig. 4.
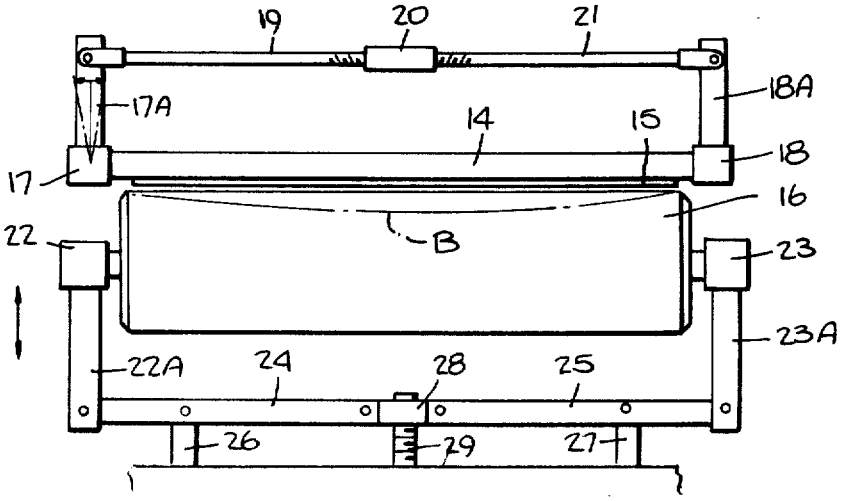

40
32
37
38
35
21
19
20
36
18A
17A
41
42
18
17
15
48
22
23
45
16
23A
30
22A
24
28
25
47
31
29
44
33
46
43

MACHINE FOR ROLLING AND CURVING PRINTING PLATES

BACKGROUND OF INVENTION

This invention relates generally to machines for rolling and curving metal sheets, and more particularly to a machine adapted to impart a desired compound curvature to a printing plate whereby the shaped plate is conformable to the surface of a printing cylinder.

In the flexographic process, printing is effected by rubber printing plates mounted on printing cylinders, the paper to be printed being impressed on the inked printing plates. In lieu of mounting rubber plates directly onto the surface of the printing cylinder, in recent years it has become the common practice to make use of metal-backed rubber plates which are attachable to the printing cylinder.

Metal-backed rubber plates have several significant advantages over plain or unbacked rubber plates. Because of the restraining action of the metal backing during the rubber molding process, improved color-to-color registration is realized. And because the register is molded into the metal-backed plate, it can be positioned in only one way, making it easier for the pressman to attach the plate to the printing cylinder.

Moreover, by punching holes in the metal-backed rubber plate in the non-printing areas thereof, one is able to use dowel pin registering devices whereby accurately-placed pins installed on the printing cylinder cooperate with these holes. It also becomes feasible by using a metal backing of ferromagnetic material, to securely attach the plate to a cylinder having magnetic elements embedded therein, thereby obviating the need for mechanical holding devices such as straps, clamps and bands.

The use of metal-backed printing plates is not limited to the flexographic process, for some dry-offset and letter press plates are provided with metal backings of sheet aluminum, printing being effected by means of an etched zinc or magnesium face layer.

All of the above-described printing plates are fabricated in the flat or planar state, and it becomes necessary therefore that these plates have a curvature set therein so as to conform them to the circumference of the printing cylinder onto which they are to be mounted, provided that these plates are to be held or clamped to the cylinder only along their circumferential edges and not by their ends.

The most commonly used machines for imparting a desired curvature to a flat printing plate are of the two-roll type, such as those disclosed in U.S. Pat. Nos. 3,304,757 and 3,371,513. In these machines, a forming roller of hard metal cooperates with a driving roller of urethane to define a nip for receiving the plate to be curved The deflectable urethane driving roller presses against the printing plate and the working surface of the driving roller acts to wrap the plate against the metal forming roller under high pressure, thereby curving the plate to the desired radius in a single pass.

The main problem encountered with all printing plates that are etched, molded or otherwise relieved to generate a printing surface, whether the plates are formed of metal-backed rubber or are formed entirely of metal or of some other material, is that the neutral plane about which bending actually takes place, does not remain in the same theoretical plane throughout the curving process but shifts position. The reason for this shift is that the thickness of the plate varies in a random manner since some areas of the plate are relieved and others are not, depending on the print pattern. Typically, the height of the printing surface above the non-printing surface is about 0.030, "whereas the overall thickness might be 0.125".

The extent to which there is a shift in the neutral plane at any one section of the plate depends, of course, on the depth of relief—the greater the depth, the more pronounced the shift. Inasmuch as the radius of curvature of the plate is a direct function of the location of the neutral plane, with known types of two-roll curving machines, this presents a problem, for it becomes difficult if not impossible to impart a uniform or predictable curvature to the plate.

All curving machines of the type heretofore known, including the three-roll benders used in the metal working industry as well as the two-roll type disclosed in the above-identified patents, because of the above-noted shift in the neutral plane, tend to develop flat segments on relief-printing plates during the curving process. These flat segments only approximate an arcuate shape and give rise to poor quality printing.

Another serious problem experienced with a two-roll curving machine, whether used with a metal plate or a metal-backed rubber printing plate, is that an enormous amount of pressure is required to curve metal which is tempered and extremely tough. When the necessary high pressure is developed at the bite between abutting rollers, one of the rollers tends to deflect and belly out and this belly is imparted to the sheet metal being rolled. Though U.S. Pat. No. 3,371,513 seeks to avoid bellying by the use of a forming roller having antideflection characteristics, the use of an antideflection forming roller, because of its construction, imposes certain minimum diameter requirements and this, in turn, limits the minimum radius of curvature that can be imparted to the plate being worked on.

A particular requirement which existing curving machines cannot fulfill is with regard to metal-backed flexographic printing plates. With such plates, it is desirable that the radius of curvature be slightly larger at the edges of the plate than at the middle, the transition or increment of radius increasing gradually from the center of the plate outwardly toward either edge, thereby generating a hyperbole of revolution. Hence a properly curved, metal-backed flexographic printing plate should have a compound curvature.

SUMMARY OF INVENTION

In view of the foregoing, it is the main object of this invention to provide an improved rolling and curving machine for imparting predictable curvatures to a metal or metal-backed printing plate.

A significant feature of the machine in accordance with the invention is that it is capable of imparting uniform curves to printing plates in a broad range extending from a relatively small to a large radius of curvature.

More particularly, it is an object of this invention to provide a machine of the above-type which is capable of imparting a compound curvature to the sheet being worked on, whereby the sheet not only has an arcuate formation from end to end to define a generally cylindrical plate which is receivable on the circumference of a printing cylinder, but also has a radius of curvature which increases gradually from the center toward either edge thereof.

Yet another object of this invention is to provide a machine which operates efficiently and reliably and is easy to adjust to attain desired values of curvature.

Briefly stated, these objects are attained in a machine for rolling arcuate sheet metal shapes, which machine includes a metal deflection bar of relatively large diameter having a longitudinal groove cut therein for receiving and partially recessing a forming roller, preferably fabricated of nylon.

The deflection bar is supported between a pair of clamp blocks which are pivotally mounted on the sides of the machine frame. Attached to each block and extending upwardly therefrom is a crank arm. The arms are pivotally connected to axially-aligned rods whose adjacent ends are joined by a turnbuckle whereby rotating of the turnbuckle causes the rods to be drawn closer together, thereby tilting the clamp blocks and causing the deflection bar and the forming roller associated therewith to assume a bow formation.

Cooperating with the forming roller is a rubber covered driving roller mounted in bearings which are slidable along the sides of the machine frame, means being provided to concurrently raise or lower the bearings to adjust the pressure applied by the driving roller against a metal sheet inserted between the forming roller and the driving roller.

In operation, the driving roller is motor driven, whereas the forming roller is caused to rotate by movement of the metal plate forced against it by the driving roller. As the metal printing plate being worked on passes between the cooperating rollers, the elastic rubber surface of the driving roller presses the metal sheet against the relatively unyielding nylon roller which functions as a former and serves to roll the sheet into an arcuate form free of flats.

But because the forming roller is deflected and has a slight bow therein, the pressure exerted on either side of the center of the forming roller is gradually reduced as one goes toward either end of this roller, thereby bringing about a corresponding increase in the radius of curvature of the metal sheet subjected to this pressure.

In this way, the printing plate is caused to assume a cylindrical formation appropriate to the printing cylinder onto which it is to be mounted, the radius of curvature of the plate being slightly larger at the edges than at the middle.

OUTLINE OF DRAWING

For a better understanding of the invention as well as other objects and further features thereof, reference is made to the following detailed description to be read in conjunction with the accompanying drawings, wherein:

FIG. 1 is a perspective view of a conventional metal-backed flexographic rubber printing plate;

FIG. 2 shows this plate after it has been rolled and curved in a machine in accordance with the invention so that it conforms to the circumference of a printing cylinder;

FIG. 3 shows another example of a metal-backed rubber printing plate curved by a machine in accordance with the invention to conform to a printing cylinder having a larger diameter;

Figure 5:
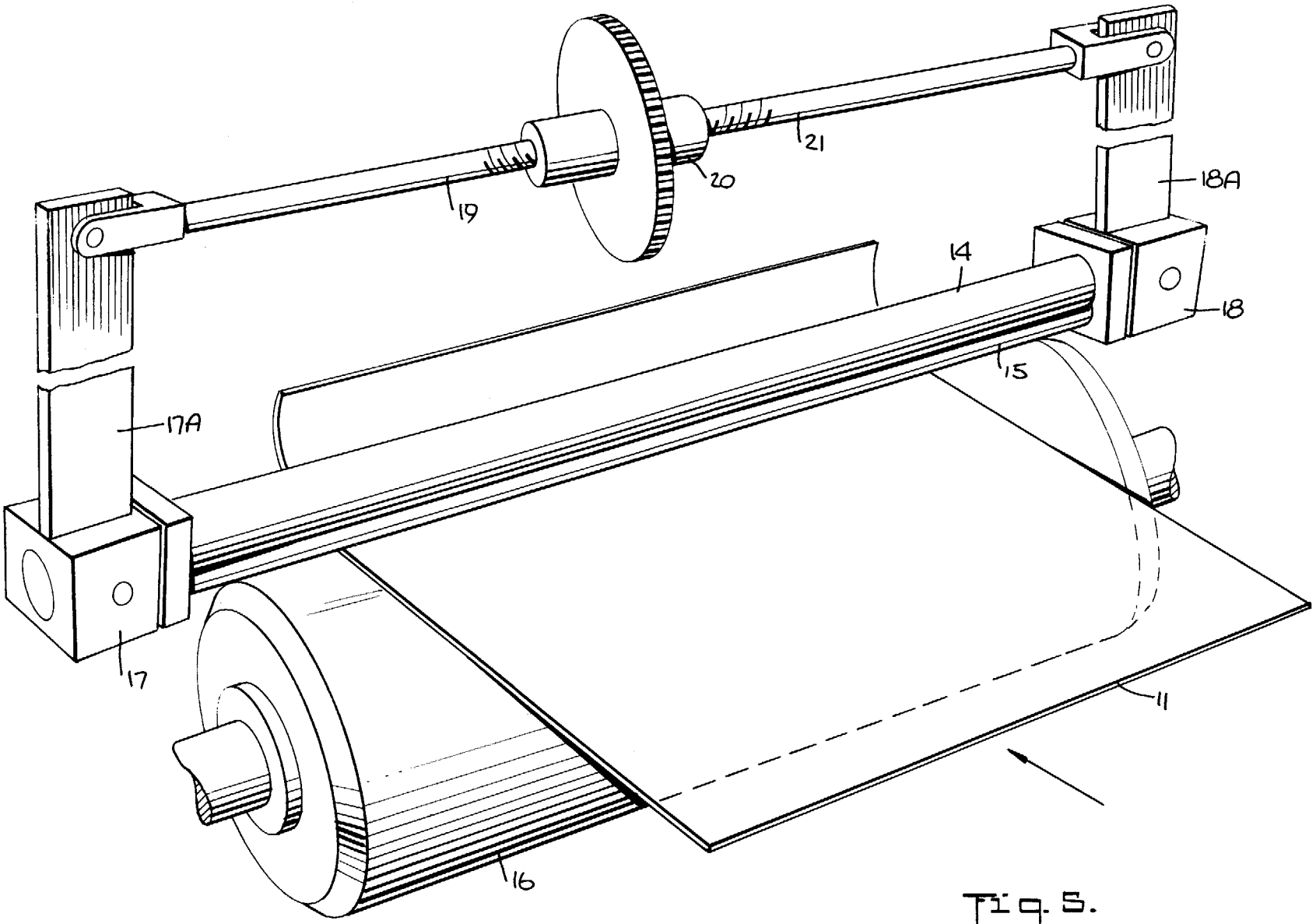
Figure 6:
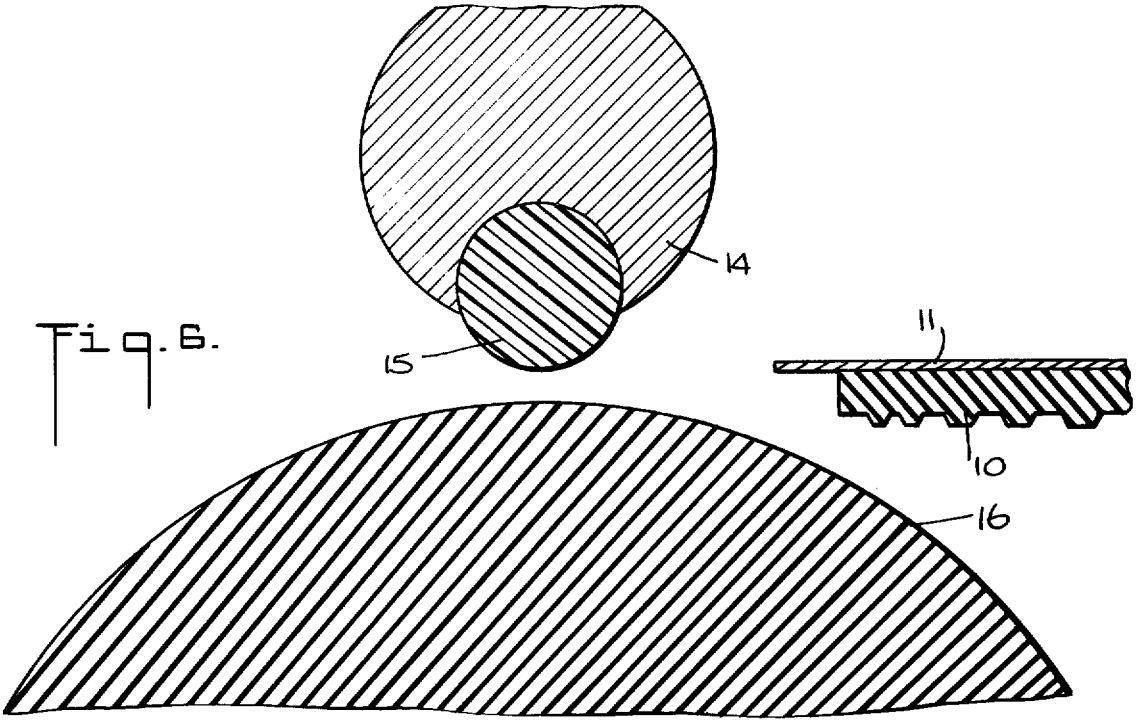
Figure 7:
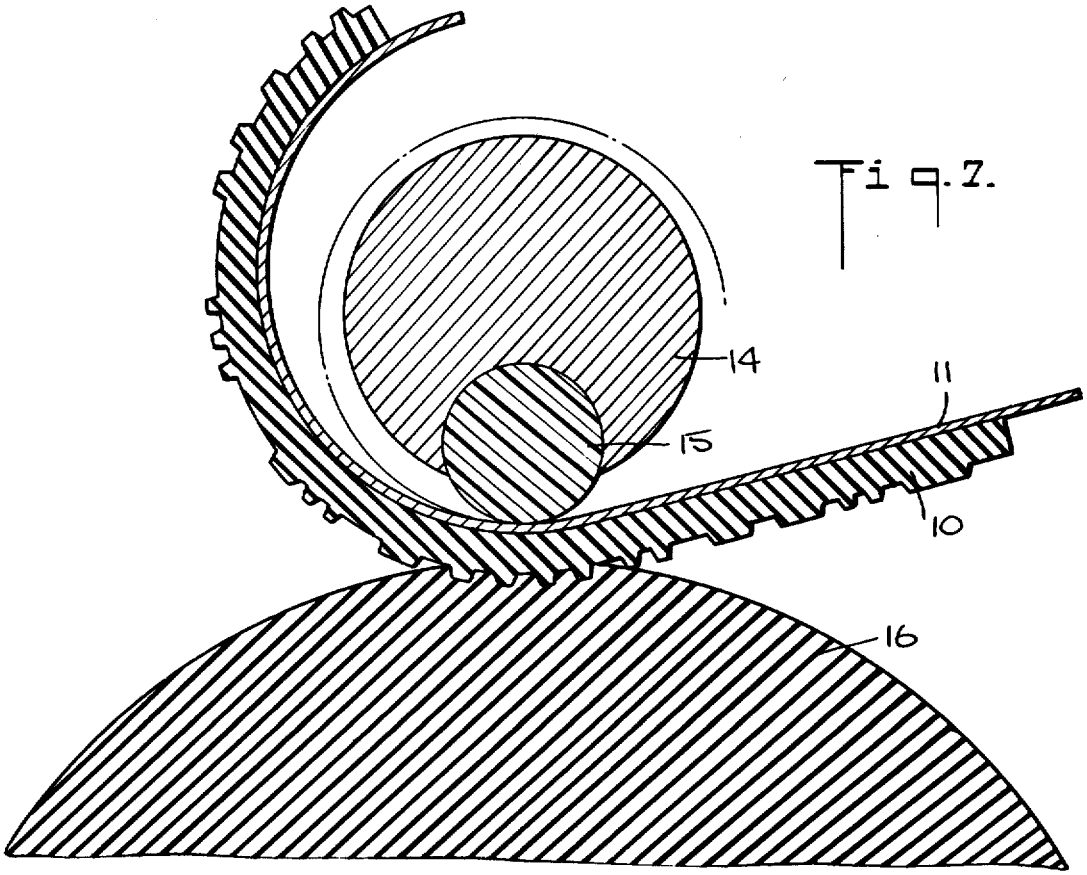
Figure 8:
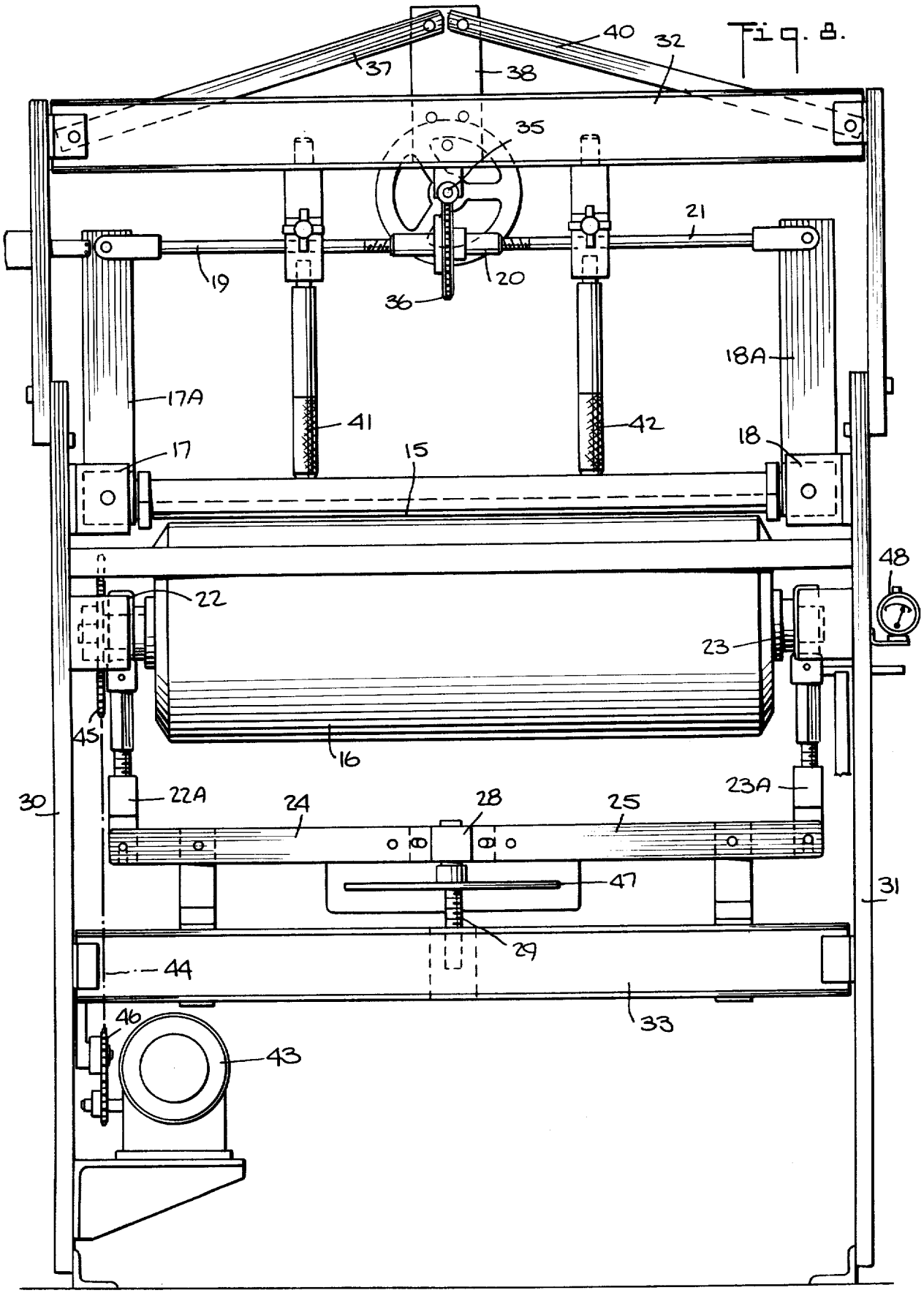

FIG. 4 schematically shows the essential components of a machine in accordance with the invention for rolling arcuate shapes;

FIG. 5 illustrates in perspective a flat metal sheet passing between the cooperating rollers of the machine and having a curve imparted thereto;

FIG. 6 is a transverse section taken through the rollers of the machine, with a metal-backed flexographic printing plate being conveyed toward the nip of the rollers;

FIG. 7 shows the metal-backed plate being curved in the course of rolling;

FIG. 8 is a front elevational view of the machine; and

Figure 9:
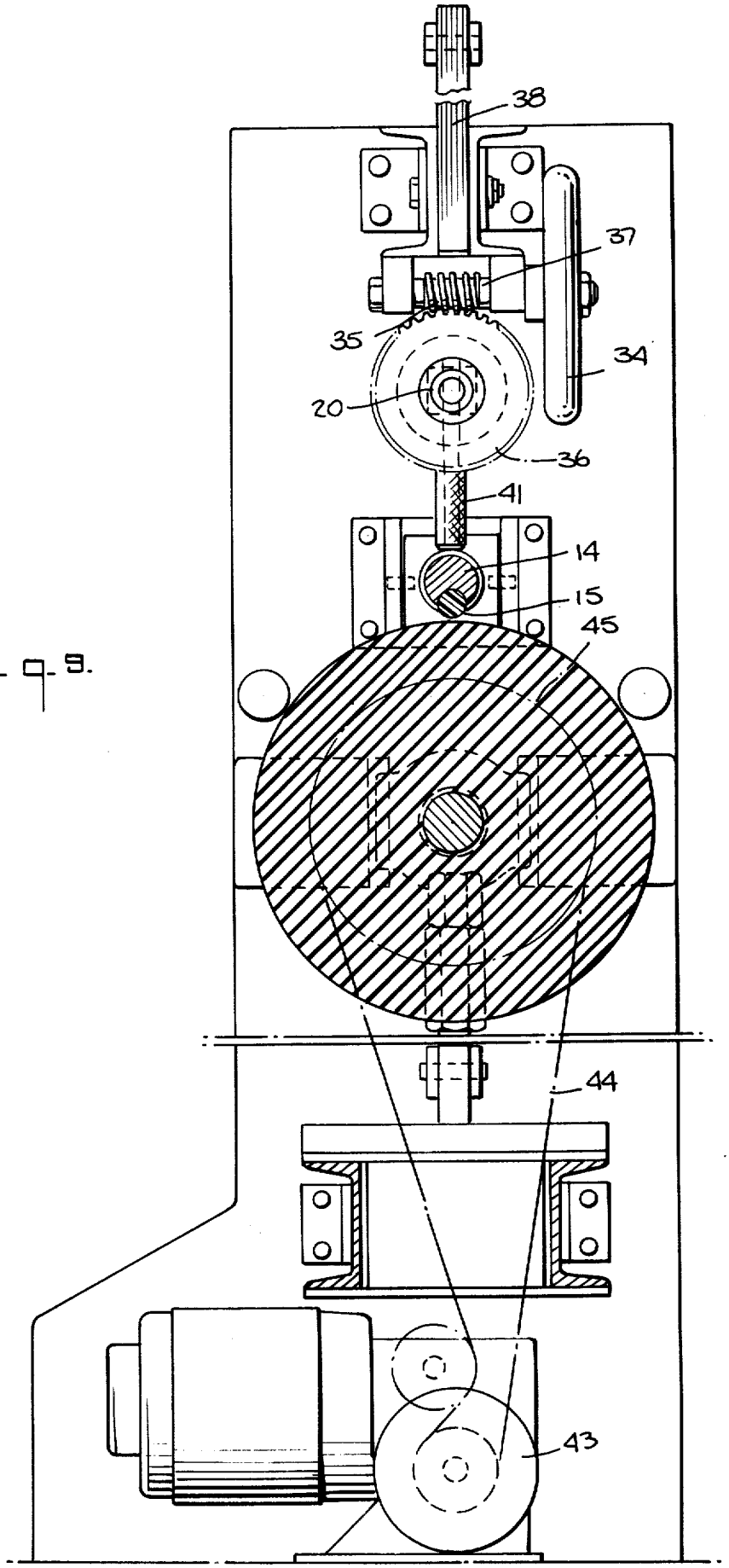

FIG. 9 is an end view of the machine.

DESCRIPTION OF INVENTION

Referring now to FIG. 1, there is shown a typical metal-backed flexographic printing plate which is fabricated in flat or planar form and therefore must be curved in order to conform to a printing cylinder. While a flexographic plate is shown, it will be appreciated that a machine in accordance with this invention is capable of operating with any type of deformable sheet metal to roll it into an arcuate form.

The flexographic printing plate is constituted by a molded rubber layer 10 bonded to a sheet metal backing 11. In order to shape this plate so that it will conform to the circumference of a printing plate cylinder 12, it must be set into a similar cylindrical shape, as shown in somewhat exaggerated form in FIG. 2, where it will be seen that the curved plate is flared on either side of the center so that the radius at the edges is larger than the center radius. In practice, this difference is only slight and is not as apparent as in FIG. 2.

In FIG. 3, the printing cylinder 13 has a larger diameter than cylinder 12 illustrated in FIG. 2; hence the printing plate 10'—11' in this instance is appropriately larger, in which event the curving machine must be capable of rolling with a larger radius.

Referring now to FIGS. 4 to 7, there is illustrated the essential components of a two-roller metal curving machine in accordance with the invention capable of imparting curvature to printing plates. The machine includes a deflection bar 14 of a suitable metal, such as magnesium or stainless steel, having a fairly large diameter which in practice is at least two inches but may be substantially larger. Received within a longitudinal groove cut into the surface of deflection bar 14 is a roller 15, the roller being partly recessed in the deflection bar so that it projects therebelow. Roller 15, which is preferably formed of nylon or other rigid plastic material of high compressive strength, is backed by the deflection bar and functions as a rotating former.

Because of the relatively small diameter of forming roller 15 (i.e., about 3/8 of an inch to 1 inch, but preferably 5/8 of an inch), it becomes possible to curve printing plates to a smaller diameter than that of the deflection bar, while taking advantage of the reinforcement afforded by the deflection bar. This is important under conditions of high pressure. In practice, when making printing plates with a small radius of curvature (see FIG. 7), one must guide the plate away from the circumference of deflection bar 14 to prevent the reentry of the plate into the nip of the rollers.

Cooperating with forming roller 15 is a driving roller 16 of relatively large diameter, this roller being heavily covered with an elastomeric material such as rubber. The rubber is of a relatively soft constituency such as that provided by Shore "A" Durometer 40.

Deflection bar 14, as shown in FIG. 4, is supported between a pair of square clamp blocks 17 and 18 which are pivotally mounted in the side frame of the machine (to be later described). Attached to clamp block 17 and extending upwardly therefrom is a crank arm 17A, and similarly attached to clamp block 18 is a crank arm 18A.

Pivotally coupled to the upper end of crank arm 17A is a horizontally-extending rod 19 whose threaded end is received within one side of a turnbuckle 20, the other side of which receives the threaded end of a rod 21 which is axially aligned with rod 19 and is pivotally coupled to the upper end of crank arm 18A. Thus depending on the direction in which turnbuckle 20 is turned, rods 19 and 21 are either brought closer together or are separated from each other, thereby causing clamp blocks 17 and 18 to swing concurrently to more or less bend deflection bar 14. In practice, tightening of the turnbuckle causes deflection bar 14 to assume a concave formation and to impart a curved bow to forming roller 15, as indicated in exaggerated fashion by dashed line bow B.

Inasmuch as the operation of the turnbuckle results in deflection of bar A, and this action may require considerable force, shaft 37 is supported on bearings formed at the end of a mounting plate 38 which is firmly held in place by struts 39 and 40 whose ends are bolted to the side frame. Depending from cross brace 32 at spaced positions therebelow are a pair of vertical abutments 41 and 42 which engage the surface of deflection bar 14 so that when clamp blocks 17 and 18 are caused to tilt toward each other, the deflection bar and the forming roller 15 held thereon are forced to assume a bow formation.

Driving roller 16 is operated by means of a motor 43 whose gear train is linked to a sprocket chain 44 engaging a sprocket wheel 45 on the shaft of this roller. Sprocket chain 44 is held taut regardless of the adjusted position of the driving roller by means of a spring-biased idler sprocket wheel 46. Adjustment of the position of driving roller 16 is effected by a wheel 47 mounted on elevator post 29 whose lower end is socketed within cross brace 38, so that by turning wheel 47 one may raise or lower the driving roller.

Thus by adjusting the position of driving roller 16 relative to forming roller 15, one may set the machine pressure to impart a desired curvature, in the end to end direction, to the printing plate passing between the cooperating rollers, and thereby conform the plate to the circumference of the printing cylinder for which it is intended. By adjusting the bow curvature of the deflection bar and forming roller assembly, one may further set the machine to impart a desired gradual increase in the radius of the curved plate from the center to the edges thereof. The amount of pressure applied by the driving roller 16 to the forming roller is indicated by a calibrated pressure meter 48.

Driving roller 16 is supported between bearings 22 and 23 which are vertically shiftable within guides in the side frame of the machine, the bearings being affixed to the upper ends of vertical posts 22A and 23A, respectively. The lower ends of these posts are hinged to levers 24 and 25 which are pivotally supported on fulcrums 26 and 27. Thus by concurrently swinging levers 24 and 25 about these fulcrums, one may adjust the position of driving roller 16 relative to forming roller 15 and thereby vary the pressure applied to the printing plate sandwiched therebetween.

The movement of levers 24 and 25 is controlled by a coupling head 28 hinged to the adjacent ends of the levers, the head being shiftable in the up and down direction by a rotatable elevator post 29.

Referring now to FIGS. 8 and 9, the main components of the machine are shown in greater detail. The side frame of the machine includes uprights 30 and 31 which are bridged by upper and lower cross braces 32 and 33. Turnbuckle 20, to which rods 19 and 21 are joined, is rotated by means of a manually-operated wheel 34 mounted at the end of a shaft 37 having a worm 35 thereon engaging a gear 36 keyed to turnbuckle 20, whereby rotation of the wheel causes the turnbuckle to turn to effect bending of the deflection bar assembly.

In operation, the printing plate may be made to go through the curving machine in several passes. The pressure applied to the plate in each successive pass is increased incrementally so as to cause the plate to assume its nominal radius of curvature in a stepwise manner rather than in a single pass. In this stepwise operation, the successive increases in pressure may be effected by programmed automatic means rather than manually.

While there has been shown and described a preferred embodiment of a machine for rolling and curving printing plates, it will be appreciated that many changes and modifications may be made therein without, however, departing from the essential spirit thereof.

Thus instead of using nylon as the material for the forming roller, other materials may be used for this purpose, such as Teflon or Teflon-coated steel. The advantage of nylon over a metal forming roller is that its low frictional resistance makes it possible for the roller to turn even when the deflection bar within whose groove or slot it is held, is subjected to a large bowing force. When the deflection bar is so bent, the nylon roller, which is engaged by this printing plate being curved, is caused to assume a similar bow, but the roller remains free to turn. Moreover, a nylon roller will not gall the slot or groove of the deflection bar, nor will it mar the surface of the metal backing of the printing plate.

We claim:

1. A machine for rolling and curving a metallized printing plate to conform it to the circumference of a printing cylinder, said machine comprising:

A. a deflection bar having a longitudinal groove therein which accommodates and partly recesses a forming roller of small diameter fabricated of a relatively unyieldable material, said deflection bar reinforcing said forming roller, B. a driving roller of relatively large diameter cooperatively disposed with respect to said forming roller and covered by a yieldable elastomeric material, C. means to adjust the position of said driving roller relative to said forming roller to vary the pressure applied to a printing plate admitted into the nip between said rollers, and D. power means to rotate said driving roller whereby the plate advancing through said nip is forced by the working surface of the driving roller to wrap against the unyieldable forming roller under high pressure, thereby curving the plate.

2. A machine as set forth in claim 1, wherein said forming roller is formed of nylon.

3. A machine as set forth in claim 1, wherein said driving roller is covered with rubber.

4. A machine as set forth in claim 3, wherein said rubber has a relatively soft consistency.

5. A machine as set forth in claim 3, wherein said plate is a metal-backed rubber flexographic printing plate, the metal engaging the forming roller and the rubber the driving roller.

6. A machine as set forth in claim 1, further including adjustable means to bend said deflection bar to cause said forming roller to assume a bow-shaped configuration.

7. A machine as set forth in claim 6, wherein said means is constituted by a pair of pivoted clamp blocks secured to the ends of said deflection bar, and means to tilt said blocks to deflect said bar.

8. A machine as set forth in claim 7, wherein said clamp blocks are provided with upwardly-extending crank arms, and said means to tilt said blocks is constituted by a pair of rods hingedly-connected to the ends of said crank arms and extending horizontally therefrom, and a turnbuckle interconnecting the adjacent ends of said rods.

9. A machine as set forth in claim 8, wherein said turnbuckle has a gear keyed thereto and further including manually operated means engaging said gear to turn said turnbuckle.

10. A machine as set forth in claim 9, wherein said manually-operated means includes a wheel on whose shaft is a worm engaging said gear.

11. A machine as set forth in claim 1, wherein said means to adjust the position of the driving roller is constituted by a pair of vertical posts supporting the end bearings of the driving roller, and a pair of levers hinged to the lower ends of said posts and pivoted on respective fulcrums, whereby by swinging the levers the vertical position of the driving roller and the pressure produced thereby may be varied.

* * * * *